United States Patent [19]

Knowles

[11] Patent Number: 4,637,194

[45] Date of Patent: Jan. 20, 1987

[54] WOOD BEAM ASSEMBLY

[76] Inventor: James Knowles, 1275 Club Dr., Bloomfield Hills, Mich. 48013

[21] Appl. No.: 807,294

[22] Filed: Dec. 10, 1985

[51] Int. Cl.[4] ..... E04C 3/02

[52] U.S. Cl. ..... 52/690; 52/729; 411/471; 411/457

[58] Field of Search ..... 52/729, 690, 223 R, 52/730, DIG. 6; 411/471, 472, 493, 496, 497, 499, 457, 468

[56] References Cited

U.S. PATENT DOCUMENTS

| | | | |
|---|---|---|---|
| 327,339 | 9/1885 | Squire | 411/472 |
| 630,049 | 8/1899 | Griffith | 411/499 |
| 4,442,649 | 4/1984 | Birckhead et al. | 52/DIG. 6 X |
| 4,500,378 | 2/1985 | Reppel et al. | 52/729 X |
| 4,501,102 | 2/1985 | Knowles | 52/690 |

FOREIGN PATENT DOCUMENTS

| | | | |
|---|---|---|---|
| 2449568 | 4/1975 | Fed. Rep. of Germany | 411/457 |
| 410788 | 6/1945 | Italy | 411/472 |
| 130818 | 8/1919 | United Kingdom | 52/729 |

*Primary Examiner*—Carl D. Friedman

*Attorney, Agent, or Firm*—Cullen, Sloman, Cantor, Grauer, Scott and Rutherford

[57] ABSTRACT

An I-beam or joist is formed of a pair of horizontal, parallel wood chords connected together by a wood web. The lower chord is pre-stressed by holding it in compression during assembly of the chords and web. The chords are fastened to the web by U-shaped wire staples whose legs have bevels formed on their free ends which cause the legs to move towards each other and to cross the central axis of their respective staple as they longitudinally penetrate thewood during insertion through a chord and into the wood web. Further, plates are fastened upon the opposite faces of the web at the opposite ends of the web, thereby increasing the web thickness at the opposite ends of the beam to substantially increase the allowable shear stress limits of the beam.

10 Claims, 15 Drawing Figures

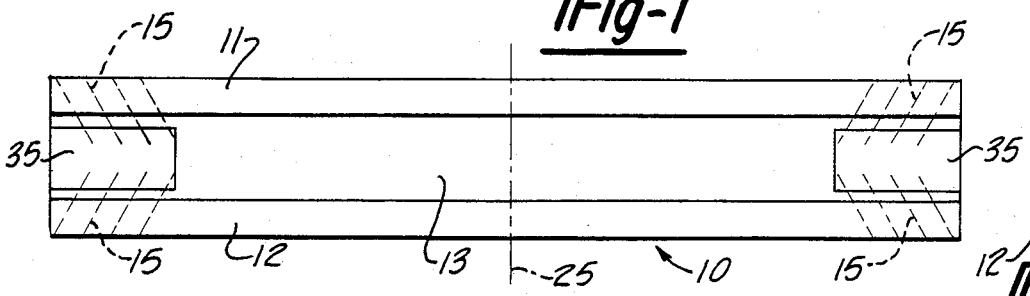
Fig-1
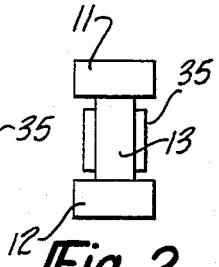
Fig-2
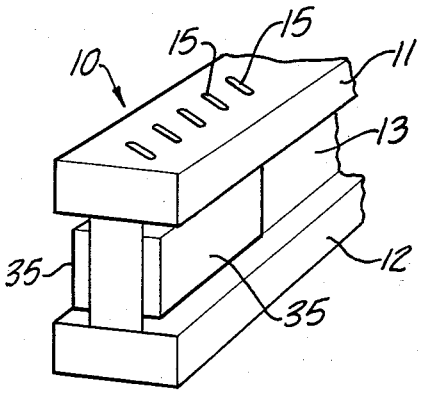
Fig-3
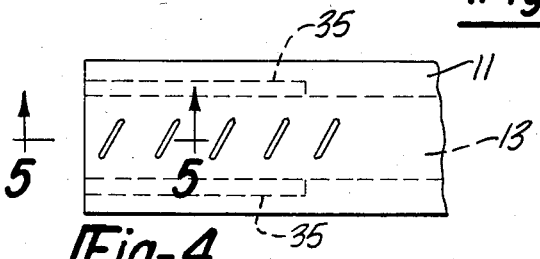
Fig-4
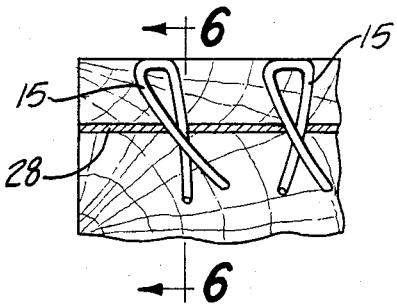
Fig-5
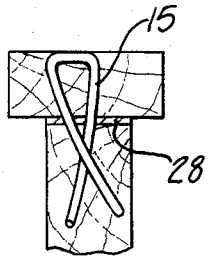
Fig-6
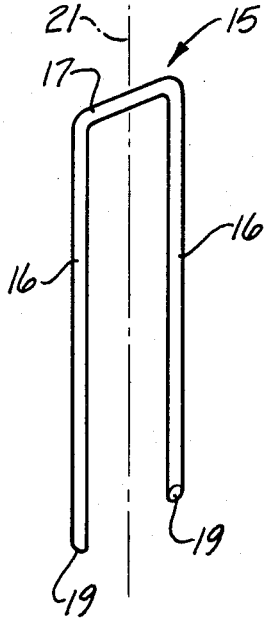
Fig-7
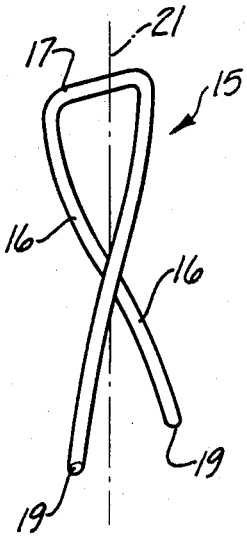
Fig-8
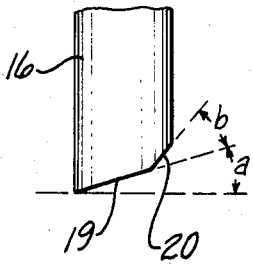
Fig-9
Fig-10
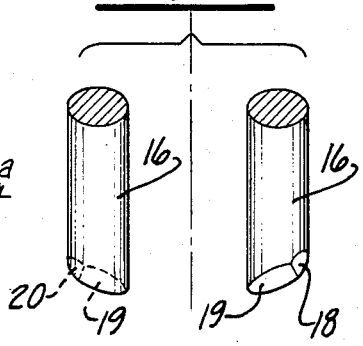
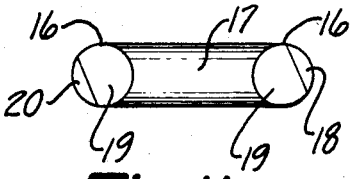
Fig-11

WOOD BEAM ASSEMBLY

BACKGROUND OF INVENTION

This invention relates to improvements in a composite wood beam assembly which is used as a joist to support, for example, building roof structures and the like. An example of such a composite wood beam is disclosed in my U.S. Pat. No. 4,501,102 issued Feb. 26, 1985. In that patent, the described beam is formed of wood chords connected together by wood web members and metal web members which provide a strong, durable, beam assembly useful as a joist.

Beams useful as joists have been made of assemblies of wood parts, that is, wood chords and webs. The capability of such wood beam assemblies to support loads, such as directly applied roof loads, tensile and compressive loads, shear stresses and the like, are generally known and can be calculated by those skilled in the art. The maximum load and stress carrying ability of a beam is generally related to the size of the beam, that is, its length and its cross-sectional size, as well as the particular material of which the beam is fabricated. As a general rule, larger loads require larger cross-section beams or more beams of lesser cross-sectional sizes.

The beam of this invention incorporates changes in several of the beam elements which coacting together, substantially increase the load carrying capacity of the beam without increasing the cross-sectional size of the beam or necessitating increasing the quality of the wood used in its construction. One such change is directed towards the wire staples which have been utilized in the past for fastening the wood members together. Such staples have been made of relatively stiff wire that is bent into U shapes. Typically the staples have been connected together into rows or strips which are inserted within conventional stapling guns for application of the staples. Such staples have been used either in place of or along with nails.

Such staples, as well as the commonly used nails, have a tendency to loosen relative to the wood within which they are embedded, particularly due to the expansion, contraction and bending which normally takes place in wood structures. Thus, while stapling is a fast and economical way of making mechanically fastened joints or connections between wood members, a relatively large number of staples are needed to meet particular strength requirements and even then, loosening of the staples can occur over a period of time.

The typical long, U-shaped staples have legs that are considerably longer than their bases or bights. Thus, there is a tendency for the long, relatively wire staple legs to wander off their driven courses during the staple gun insertion which results in their breaking through the sides or edges of the wood members. The exposure of some of the staples through the surfaces of the wood members occurs frequently. The staple of this present invention obviates this problem.

Further, the wood members which are used for beams are typically made of uniform cross-section lumber. Therefore, they are generally of uniform strength along their lengths. Consequently, in order to handle any localized larger forces or loads at specific areas in a joist as compared to areas handling local forces, the wood members must be of a sufficient size throughout their lengths to handle the larger anticipated loads. For example, if a particular anticipated load requires a 2×6 inch beam because of heavy shear stresses at opposite ends of the joist, then the entire beam must be made of that particular size even though other areas of the joist do not require that large a size. Thus, this invention relates to a means for locally increasing the end shear stress bearing capacity of a particular size beam so as to permit the use of smaller cross-sectional size beams or less beams for a particular building construction.

SUMMARY OF INVENTION

The invention herein relates to a composite wood beam assembly made of a pair of horizontal, spaced apart, wood chords joined together by a wood web extending the length of the beam. Wire staples are used to fasten the chords to the web. These staples are formed with beveled free ends that are shaped so as to cause the legs to bend and cross the axis of the staple during insertion into the wood so as to better lock within the wood and prevent staple leg breakouts through the faces of the wood. Moreover, such staples are arranged at predetermined angles to substantially increase the strength of the joints formed by them.

The invention further contemplates utilizing conventional sizes of lumber for the wood chords and webs, but substantially increasing the load carrying capacity of the particular size wood members. First, this includes pre-stressing the lower chords under compression during manufacture of the beam assembly. Second, plates are fastened upon the opposite faces of the web at the opposite ends of the web so as to locally increase the web shear stress capacity, i.e., at the highest shear stress localities.

The use of the wire staples whose legs cross the staple axis and each other as they are inserted into the wood, the compressive pre-stressing of the lower chords, and the provision of the web end plate's thickness in the area or field of highest shear stress, coacting together, substantially increase the strength and load carrying capacity of any particular size beam. This makes it possible to use smaller size beams to handle loads which are beyond those previously contemplated or alternatively, to use less beams than previously required for a particular load.

An object of this invention is to substantially increase the load carrying capacity of any particular cross-sectional size wood beam assembly, without any substantial increase in the cost of the finished beam. This is accomplished: (a) by forming the ends of the legs of the wire staples so that they tend to cross the staple axis during longitudinal penetration into the wood, (b) by compressively pre-stressing the lower chord during the time that the beam chord and web members are assembled together using both adhesive and staples, (c) and by adding plates at the high shear stress fields at the opposite ends of the beam. The improved beam assembly is used in the same way as conventional beams are used in construction. Thus, the essential object of this invention is to substantially increase the strength of a particular beam, without materially affecting its cost or its manner of use.

These and other objects and advantages will become apparent upon reading the following description of which the attached drawings form a part.

DESCRIPTION OF DRAWINGS

FIG. 1 is an elevational view of a composite I-beam assembly, with the staple fasteners schematically shown in dotted lines.

FIG. 2 is an end elevational view of the beam.

FIG. 3 is a perspective, fragmentary view of one end of the wood I-beam.

FIG. 4 is a fragmentary plan view of the end of the beam shown in FIG. 3.

FIG. 5 is a cross-sectional, enlarged, view of a fragment of the beam, taken in the direction of arrows 5—5 of FIG. 4, showing the staples.

FIG. 6 is a cross-sectional view taken in the direction of arrows 6—6 of FIG. 5, to illustrate the position of a staple relative to the upper chord and web.

FIG. 7 is an enlarged perspective view of a single staple.

FIG. 8 is a perspective view of a staple with its legs bent into the cross-axis position resulting from the longitudinal insertion of the staple into the wood.

FIG. 9 is an enlarged, fragmentary, elevational view of the lower end of one of the legs of a staple.

FIG. 10 is an enlarged, fragmentary perspective view of the lower ends of a staple, and FIG. 11 is a bottom view of the staple leg ends shown in FIG. 10.

DETAILED DESCRIPTION

Figure 12:
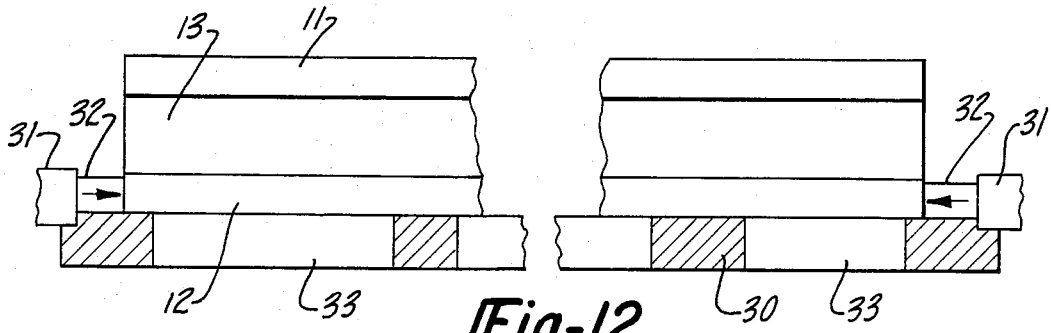
FIG. 12 is a schematic view showing the pre-stressing of the lower chord during assembly of the beam.

As illustrated in FIGS. 1–3, the composite wood beam assembly 10 is formed of an upper chord 11, a lower chord 12 and a web 13. By way of example, the chords may be formed of 2×4's or other standard size wood strips. In the drawings, the upper and lower chords are illustrated as being formed of 2×4's laid on their sides while the web is formed of a 2×4, or a 2×6, 2×8, 2×10, or 2×12 arranged upright.

The staples 15 (see FIG. 7) are formed of stiff wire bent into U-shapes to provide long legs 16 that are at least several times longer than the base or bight 17 of each staple. The free ends of each of the legs are cut into a face bevel 19 and a small edge chamfer 20, as illustrated in FIG. 9. The angle a of the bevel 19 is preferably in the range of between about 10–14 degrees relative to the axis 21 of the staple. Likewise, the angle b of the smaller chamfer 20 is also preferably in about that same range relative to the bevel, although it may be varied somewhat. The beveled surfaces are also angled slightly, in opposite directions, at roughly the same angles mentioned, relative to the flat plane of the staple. This opposite angling can be seen in exaggerated schematic form in FIG. 10.

Figure 15:
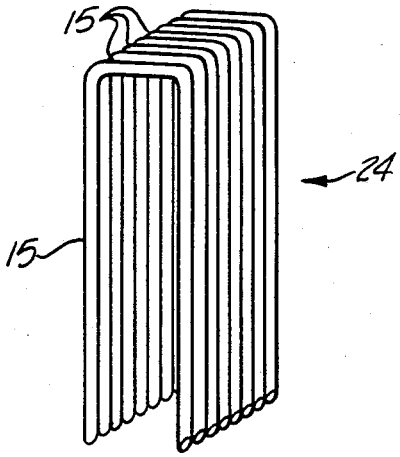
FIG. 15 is a perspective view of a row or strip of staples for use in a typical stapling gun.

The staples may be formed in a group or row 24 (see FIG. 15) similar to conventional staple rows which are used in conventional staple guns. While the staples may vary in size, an example of one suitable size staple is about 3½ inch long legs, with about a 9/16 inch bight, and formed of stiff steel wire of about 0.080 inches diameter.

When the staples are applied into the wood members for fastening the chords to the web, they are angled relative to the transverse direction of the chords. That is, preferably they are angled at about 30 degrees relative to the transverse direction of the chords (See FIG. 4). In addition, the staples are also angled relative to the vertical, as illustrated by the dotted lines at the opposite ends of the beam in FIG. 1. As shown by the dotted lines, the staples in the upper chord are angled downwardly towards the central axis 25 of the beam, whereas the staples in the lower chord are angled upwardly towards the central axis 25. Preferably, the angularity is roughly around 45 degrees.

As each staple is inserted into the wood by the staple gun, the legs of the staple tend to move towards and then to cross the central axis of the staple. Also, they spread slightly apart relative to each other. This movement is due to the shape of the free ends of the legs. The cross of the legs relative to the staple axis is schematically illustrated in FIGS. 5 and 6. Such crossing of the legs prevents the legs spreading outwardly and breaking out through the side walls of the web or the chords. In addition, the movement of the legs provides a good interlock between the staple legs and the fibers of the wood members. The resulting connection formed by the staple fasteners is considerably stronger and resistant to staple loosening than a conventional stapled joint.

A suitable adhesive 28 (see FIGS. 5 and 6) is applied at the joints formed by the face to face contact of the chords with the opposite edges of the web. The assembly of the wood members, which is schematically illustrated in FIG. 12, includes applying the adhesive or suitable glue upon the opposite edges of the web and, if necessary, the contiguous faces of the chords. The wood parts are placed upon a suitable support table 30 which has compression devices 31. The devices may be in the form of hydraulic or pneumatic cylinders with compression pistons 32, that move sideways towards each other to bear against the opposite ends of the lower chord 12. While the glue is still wet and not yet cured, the lower chord is compressed a pre-determined amount while the web and upper chord are loosely arranged upon it.

Next, the chords are fastened to the web by applying the staples using a conventional stapling gun. To facilitate stapling the lower chord to the web, access openings 33 are formed in the table for the stapling gun. Consequently, when the compression device 31 is released, the beam lower chord remains pre-stressed due to the adhesive and the holding action of the staples.

Because the lower chord is pre-stressed under compression, when the beam is positioned as a joist or header to support loads, the lower chord is placed in tension while the upper chord is placed in compression. The tension forces or stresses of the lower chord are reduced by the amount of the pre-stress compression applied during the assembly. Hence, the lower chord, and therefore, the beam, can handle a much greater tension stress along its lower portion than a conventional beam or joist. Restated, the pre-stressing of the lower chord provides a lower induced tensile stress for any particular load applied to the joist. This increases the maximum tensile stress capacity of a beam, and makes it possible to use the beam to handle a larger load than would otherwise be possible.

Figure 13:
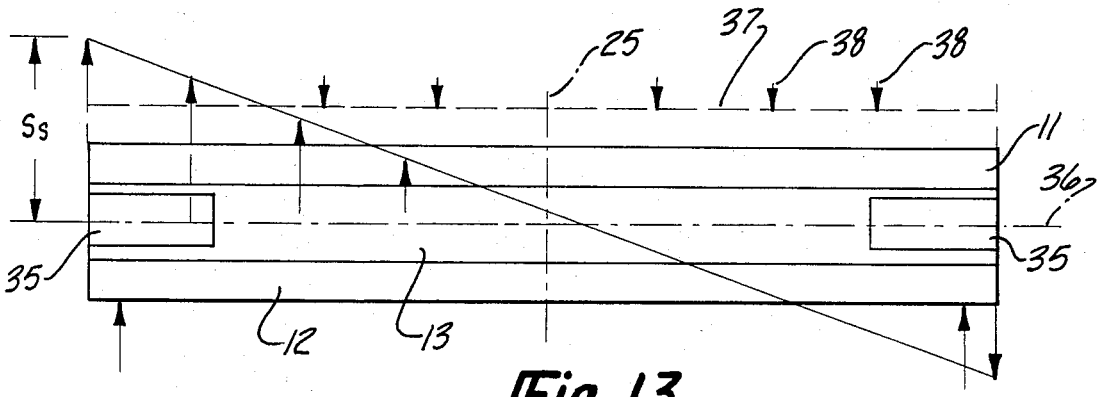
FIG. 13 is a schematic diagram showing the nature of the shear stress upon a loaded beam.

Sheer stress plates are applied upon the opposite faces of the web at the opposite ends of the beam, as illustrated in FIGS. 1 and 13. These plates 35 may be formed of plywood that is secured to the web by means of nails, staples or adhesive or combinations of these. Alternatively, a stiff metal plate may be used, as for example a steel, sheet metal plate with struck-out teeth for embedding into the wood. Such metal plates are commonly used as nailing plates to form joints on wood trusses. These plates 35 reinforce the ends of the web in a manner somewhat similar to thickening the ends of the web in the area or field of maximum shear stress. The horizontal lengths of such plates will depend upon the design load of the beam. For example, the plates may be 24 inches long for a 2×10 inch web.

FIG. 13 schematically illustrates a shear stress diagram superimposed upon the beam. The shear stress, designated as $S_s$ varies from maximum at the outer ends of the beam to zero in the horizontal plane at the intersection of the beam's horizontal axis 36 and vertical central axis 25. In this diagram, the uniformly applied load is illustrated by the dotted line 37 with the superimposed arrows 38.

Figure 14:
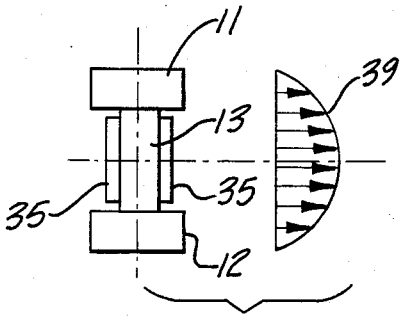
FIG. 14 is an end view of the beam with an adjacent shear stress force diagram.

The shear stress also varies in the horizontal direction, as indicated in FIG. 14 which schematically shows that the shear stress, in the horizontal direction, varies from a maximum at the horizontal center line to zero at the upper and lower extreme edges or faces of the beam. This is demonstrated by the shear stress diagram 39 in FIG. 14. The shear stress diagrams in FIGS. 13 and 14, taken together, indicate that the maximum shear stress areas or fields are close to the opposite ends of the beam.

It would be economically impractical to make a beam with a web that has a varying thickness or varying strength at its opposite ends in order to handle such increased shear stress. Consequently, the beam shear stress handling capability is determined by the cross-sectional area and strength of the areas at the ends of the web. The shear stress plates 35 secured to the opposite faces of the web are an economically practical way to increase the thickness of the web only in the shear-field or area needed to increase the allowable shear stress handling requirements of a particular size beam. With the shear stress plates, a specific cross-sectional size beam has a considerably greater shear stress handling ability for very little increase in cost. The use of the plates, combined with pre-stressing the the lower chord, permits a beam assembly to handle considerably greater forces. That, along with the considerably greater locking of the parts together by means of the cross-axis staples, produces a substantially improved beam at only a slight cost increase. With this beam, either less beams can be used for a particular load requirement or smaller cross-sectional size beams can be used to meet a particular load requirement. This reduces the overall cost of construction.

Having fully described an operative embodiment of this invention, I now claim:

1. A wood beam assembly for use as a joist and the like, comprising:

a pair of horizontally arranged wood chord members interconnected by a narrower wood web member to form a generally I-beam shaped cross-section;

shear stress plates applied upon the web at each of the opposite ends of the beam and covering the area of maximum shear stress which is located adjacent the beam ends;

the wood chord members and the web each being of substantially uniform cross-section throughout their lengths wherein the opposite ends of the web are thickened by the shear stress plates applied thereon;

and means securely fastening the chords to the web and the shear stress plates to the web, said means for fastening comprising U-shaped wire staples having legs interconnected by a bight with a center line axis extending between and parallel to the legs, the free ends of the legs being beveled at acute angles inwardly towards the center line axis of the staple and away from the bight of the U-shape, so that the legs are shorter along their external edges that are remote from the center line axis of the U-shapes, said staple legs being additionally chamfered at the outermost edges of their bevels relative to the central axis of the staples;

said staple legs crossing the center line axis due to the leg ends tending to move towards and past each other as they are forced longitudinally into the wood during application of the staples for fastening.

2. A wood beam assembly as defined in claim 1, and including the lower chord being pre-stressed in compression and said means for fastening the chords to the web also maintaining the lower chord in pre-stressed compression.

3. A wood beam assembly comprising a pair of wood chord members interconnected by a narrower wood bed member to form a generally I-beam shaped cross-section having a longitudinal axis extending the length of the beam midway between the wood chords and a center line axis extending perpendicular to both the longitudinal axis and the wood chords and spaced midway between the beam ends;

staples fastening the chords to the web, with each of the staples being formed of an elongated, relatively stiff wire bent into a U-shape having its generally parallel legs considerably greater in length than its bight and having a central axis extending between and parallel to the legs;

the free ends of the legs being beveled at angles inwardly towards the central axis and away from the bight of the U-shape, so that the legs are shorter along their external edges that are remote from the central axis of the U-shapes;

the staple legs being moved towards, and at least some of such legs crossing, the staple central axis due to their ends tending to move towards and past each other as they are forced longitudinally into the wood during application of the staples for fastening, with the staples through the upper chord being angled downwardly in a direction from their nearest outer beam end towards the center line axis of the beam and the staples in the lower chord being angled upwardly in a direction generally angled towards the center line axis of the beam from their nearest outer beam end.

4. A wood beam assembly as defined in claim 3, and wherein the staple legs are additionally chamfered at the outermost edges of their bevels relative to the central axis of the staples.

5. A wood beam assembly as defined in claim 4, and with the lower chord being pre-compressed prior to the insertion of the staples through the lower chord and into the adjacent web portions and prior to the setting of the adhesive, so that the lower chord is maintained by said adhesive and its staples in compression to provide a pre-stressed beam.

6. A wood beam assembly as defined in claim 5, and including shear plates applied against and secured to the opposite faces of the web adjacent the opposite ends of the beam to cover the areas of maximum shear stress forces on the beam.

7. A wood beam assembly as defined in claim 3, and including said staples also being angled at an acute angle relative to a plane transverse to the longitudinal axis of the beam.

8. A fastener staple for fastening wood members together, comprising:

an elongated, relatively stiff, wire formed into a U-shape having a relatively short base with generally parallel, long legs that are many times the length of the base and a center line extending midway between and parallel to the legs;

the free ends of the legs being beveled into wedge forming tips with the bevels each being angled away from the base and generally towards the center line of the U-shape and with the outer edges of the leg end bevels being chamfered;

wherein said bevels cause the ends of the legs to move towards each other and past the centerline of the staple as the legs are moved longitudinally into the wood members and said chamfers control the overall movement of the legs to prevent excessive lateral spreading of the legs;

and said bevels are additionally angled relative to the flat plane defined by the base and legs of the U-shaped staple, with the additional angle of each of the bevels being in opposite directions relative to such flat plane, such that the additional angles are asymmetrical.

9. A fastener staple for fastening wood members together, comprising:

an elongated, relatively stiff wire formed into a U-shape having a relatively short base with generally parallel, long legs that are many times the length of the base and a center line extending midway between and parallel to the legs;

the free ends of the legs being beveled into wedge-forming tips with the bevels each being angled away from the base and generally towards the center line of the U-shape and with the outer edges of the leg end bevels being chamfered;

wherein said bevels cause the ends of the legs to move towards each other and past the center line of the staple as the legs are moved longitudinally into the wood members and said chamfers control the overall movement of the legs to prevent excessive lateral spreading of the legs.

10. A fastener staple as defined in claim 9, wherein the bevels are additionally angled relative to the flat plane defined by the U-shape staple, with the additional angle of each of the bevels being in opposite directions relative to such flat plane.

* * * * *

UNITED STATES PATENT AND TRADEMARK OFFICE

CERTIFICATE OF CORRECTION

PATENT NO. : 4,637,194

DATED : January 20, 1987

INVENTOR(S) : James Knowles

It is certified that error appears in the above-identified patent and that said Letters Patent is hereby corrected as shown below:

In claim 3, line 3, delete "bed" and add --web--.

Signed and Sealed this

Twenty-first Day of April, 1987

*Attest:*

DONALD J. QUIGG

*Attesting Officer*

*Commissioner of Patents and Trademarks*